US006851948B2

(12) United States Patent
Dempsey et al.

(10) Patent No.: US 6,851,948 B2
(45) Date of Patent: Feb. 8, 2005

(54) SYSTEM AND METHOD FOR DRAFT SAFEGUARD

(75) Inventors: Daniel J. Dempsey, Carmel, IN (US); Michael L. Brown, Greenwood, IN (US)

(73) Assignee: Carrier Corporation, Farmingtron, CT (US)

( * ) Notice: Subject to any disclaimer, the term of this patent is extended or adjusted under 35 U.S.C. 154(b) by 108 days.

(21) Appl. No.: 10/388,126

(22) Filed: Mar. 13, 2003

(65) Prior Publication Data

US 2004/0180305 A1 Sep. 16, 2004

(51) Int. Cl.[7] ..... F23N 5/20
(52) U.S. Cl. ..... 431/18; 431/78; 431/80
(58) Field of Search ..... 431/6, 18, 21, 431/22, 29, 66, 68, 80; 126/116 A, 307 R; 236/10, 11, 46 E

(56) References Cited

U.S. PATENT DOCUMENTS 4,401,425 A 8/1983 Gable et al.
4,789,330 A * 12/1988 Ballard et al. ..... 431/75
4,887,767 A * 12/1989 Thompson et al. ..... 126/116 A
4,951,870 A * 8/1990 Ballard et al. ..... 431/68
5,488,218 A * 1/1996 Olsen et al. ..... 219/492
6,305,369 B1 * 10/2001 Garloch ..... 126/116 A

* cited by examiner

*Primary Examiner*—Jiping Lu
(74) *Attorney, Agent, or Firm*—Wall Marjama & Bilinski LLP

(57) ABSTRACT

A gas furnace responsive to a thermostat includes a thermal switch wired in series between the furnace power supply and the thermostat. A microprocessor connected to the thermal switch detects when the switch opens and closes, carrying out prearranged programs in response thereto. The thermal switch is mounted so that it opens when an over-pressure in the furnace draft system is detected, as evidenced by hot flue gasses passing over the thermal switch probe. The switch is allowed to cycle at least one time before the furnace is disabled. After a certain period of the time, the combustion cycle is reinitiated and the above steps are repeated if the thermal switch again resets.

25 Claims, 7 Drawing Sheets

SYSTEM AND METHOD FOR DRAFT SAFEGUARD

FIELD OF THE INVENTION

This invention relates generally to the field of gas furnaces, and in particular to a system and method for monitoring the vent system of a furnace, so as to shut down the furnace in the event the vent becomes restricted and overheats, thereby causing a pressure greater than atmospheric pressure in the vent.

BACKGROUND OF THE INVENTION

As disclosed in U.S. Pat. No. 4,401,425 to Gable et al., a manually resettable thermal switch is used to sense the temperature of flue gases within the discharge box of a forced air gas fired furnace. The thermal switch is arranged to shut down the furnace power supply and to turn off the gas valve when it senses an over-pressure condition, caused by an over-temperature condition, in the discharge box. Once the thermal switch opens, a serviceman must be called to determine the cause of the shut down and reset the switch.

Oftentimes, the thermal switch can be tripped by events other than a vent blockage, such as high wind conditions or momentary downdrafts. In the event the building being heated remains unoccupied for a long period of time during cold weather, and a trip occurs during this time, water fixtures and pipes can freeze up and burst, causing a good deal of costly damage to the structure. Service people sometimes are not readily available, and extended delays in the serviceman's arrival during cold weather can also result in broken water pipes and fixtures. Reoccurring nuisance trips where a serviceman must be called to reset the thermal switch can also be extremely annoying as well as costly.

SUMMARY OF THE INVENTION

Briefly stated, a gas furnace responsive to a thermostat includes a thermal switch wired in series between the furnace power supply and the thermostat. A microprocessor connected to the thermal switch detects when the switch opens and closes, carrying out prearranged programs in response thereto. The thermal switch is mounted so that it opens when an over-pressure in the furnace draft system is detected, as evidenced by hot flue gasses passing over the thermal switch probe. The switch is allowed to cycle at least one time before the furnace is disabled. After a certain period of the time, the combustion cycle is reinitiated and the above steps are repeated if the thermal switch again resets.

According to an embodiment of the invention, in a gas furnace that is responsive to a thermostat, and which contains a power supply, a gas valve, and an autoresettable thermal switch having a thermal switch probe that is responsive to an over-pressure condition, and a microprocessor responsive to the thermostat and the thermal switch for controlling the power supply and the gas valve, and wherein the gas furnace includes a furnace vent system, a process for detecting a blockage in the furnace vent system includes the steps of mounting the autoresettable thermal switch adjacent to an entrance to the furnace vent system so that the thermal switch opens due to a flue pressure exceeding a certain level and causing hot flue gasses to pass over the thermal switch probe; electrically connecting the thermal switch in series between the power supply and the thermostat; programming the microprocessor to carry out the following steps upon the thermostat calling for heat:

(a) instituting a combustion cycle; (b) sensing a condition of the thermal switch and detecting when the thermal switch opens; (c) determining, when the thermal switch is open, whether the number of openings of the thermal switch or the duration that the thermal switch remains open exceeds a preprogrammed criterion; (d) disabling, when the number of openings of the thermal switch or the duration that the thermal switch remains open exceeds the preprogrammed criterion, the furnace and reinstituting the combustion cycle after the furnace has been disabled for a specified period of time; and (e) allowing, when the thermal switch is open and the furnace is not in a disabled state, the thermal switch to reset and reinstituting the combustion cycle upon resetting the thermal switch.

DETAILED DESCRIPTION OF THE PREFERRED EMBODIMENT

Figure 1:
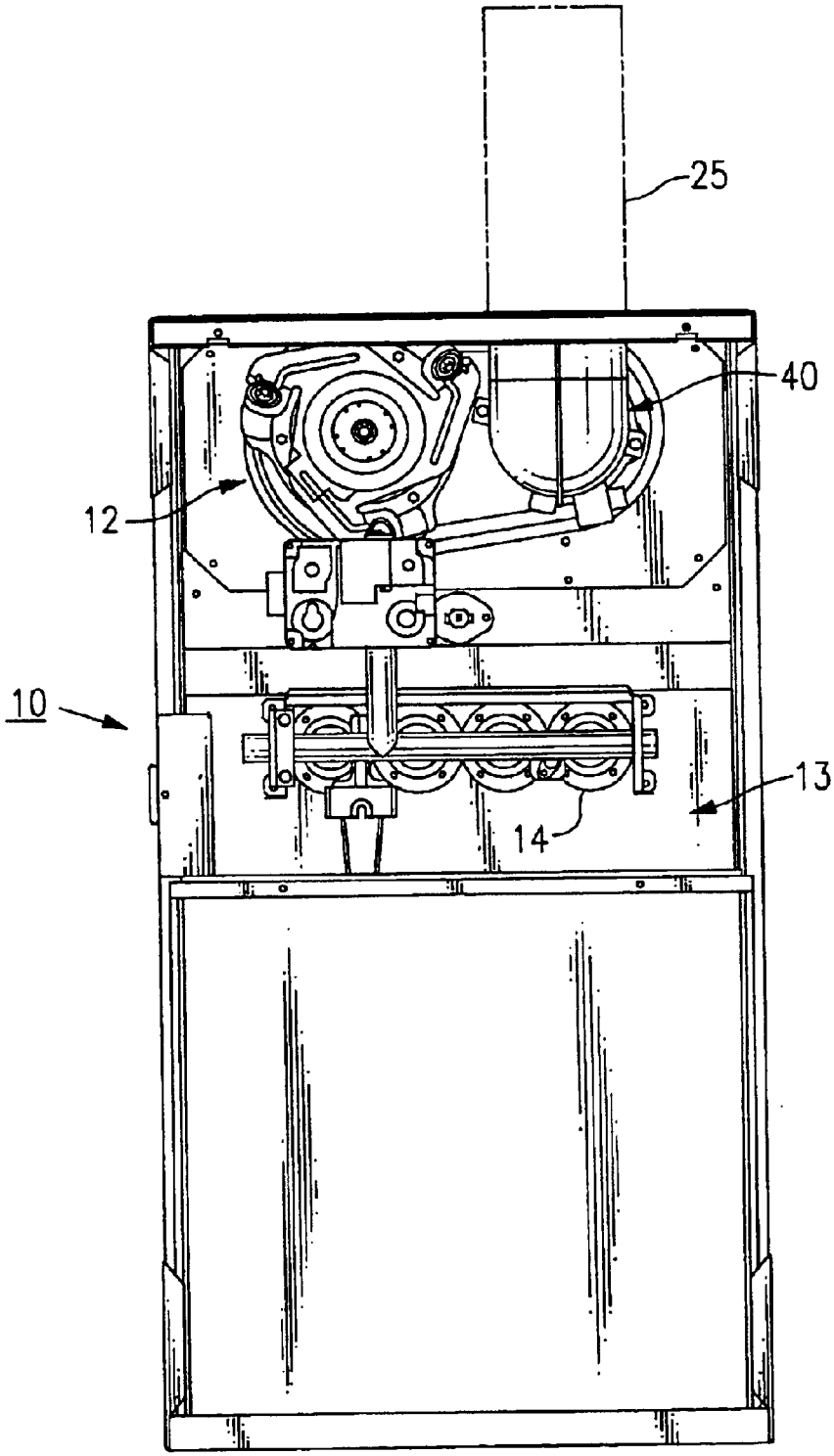
FIG. 1 shows a front elevation of a gas fired furnace embodying the teachings of the present invention with the front cover removed to better illustrate the burner and inducer sections of the furnace.
Figure 2:
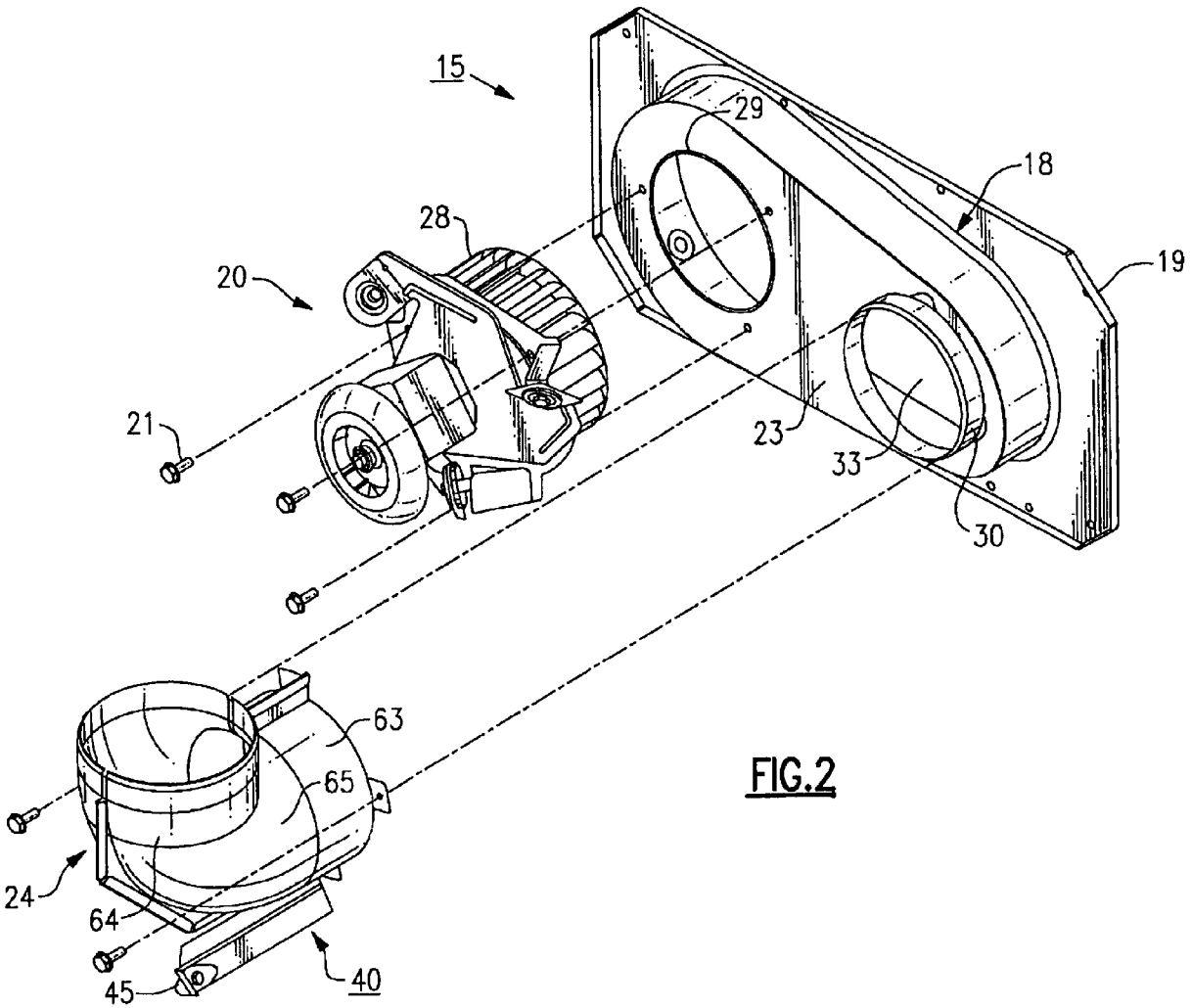
FIG. 2 shows an exploded view in perspective showing the inducer section of the furnace.

Referring to FIGS. 1–2, a gas fired multi-poise furnace, generally referenced 10, embodies the teachings of the present invention. Furnace 10 contains an inducer unit 12 that is positioned directly above a heat exchanger section 13 that is equipped with a series of gas burners 14 that are operatively connected to a gas valve control that is remotely regulated by a microprocessor so that the valve can be opened or closed as per the microprocessor program. An inducer unit is mounted directly over the heat exchanger section and is adapted to receive the flue gases from the heat exchanger.

The inducer unit is shown in greater detail in FIG. 2 and includes an inducer box 18 that is secured to a back wall 19 in assembly. The back wall faces the heat exchanger exit and has an opening (not shown) through which flue gases are admitted into the inducer box. An inducer fan motor assembly 20 is secured by screws 21 to a front wall 23 of the inducer box adjacent to an elbow 24 that forms part of the furnace vent system. The elbow is connected to a vent pipe 25 (FIG. 1) for exhausting flue gases to the surrounding ambient. The inducer fan motor assembly includes a blower wheel 28 which, in assembly, passes through an opening 29 provided in the front wall of the inducer box. When secured in place, the fan motor unit closes opening 29 and the blower wheel is in alignment with the rear opening to the heat exchanger.

Vent elbow 24 is arranged to pass over a flange 30 in the front wall of the inducer box which surrounds a flue gas discharge opening 33. As is well known, the blower wheel creates a draft within the inducer box which causes the flue gases to flow from the inducer box into the vent system. A sensor housing 40 is secured to the vent elbow and, as is explained in detail below, contains a temperature sensitive thermal switch 45 for monitoring the flue gas temperature at the entrance to the vent system.

Figure 3:
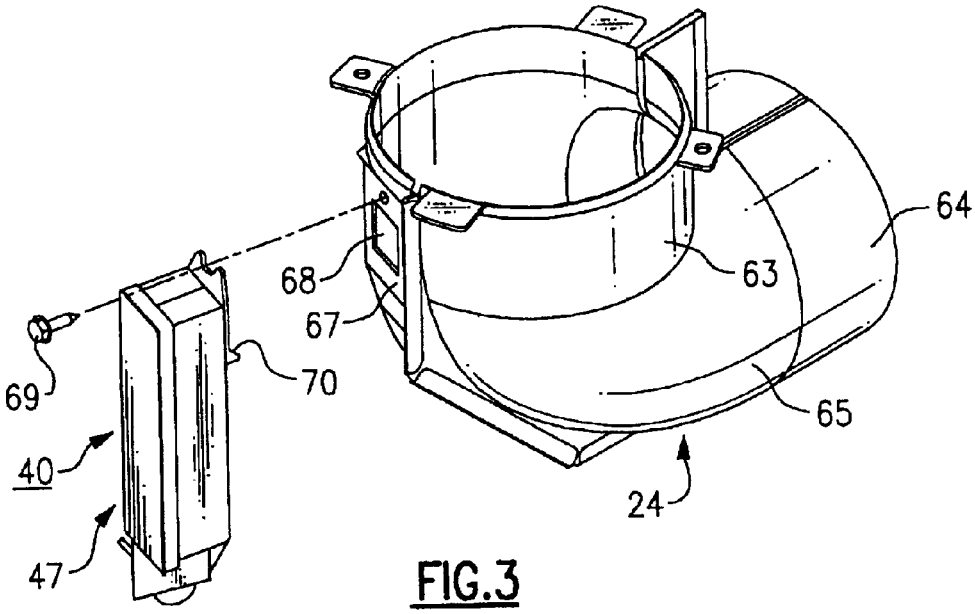
FIG. 3 shows an enlarged view in perspective of the vent system elbow and a sensor housing that is attached thereto.
Figure 4:
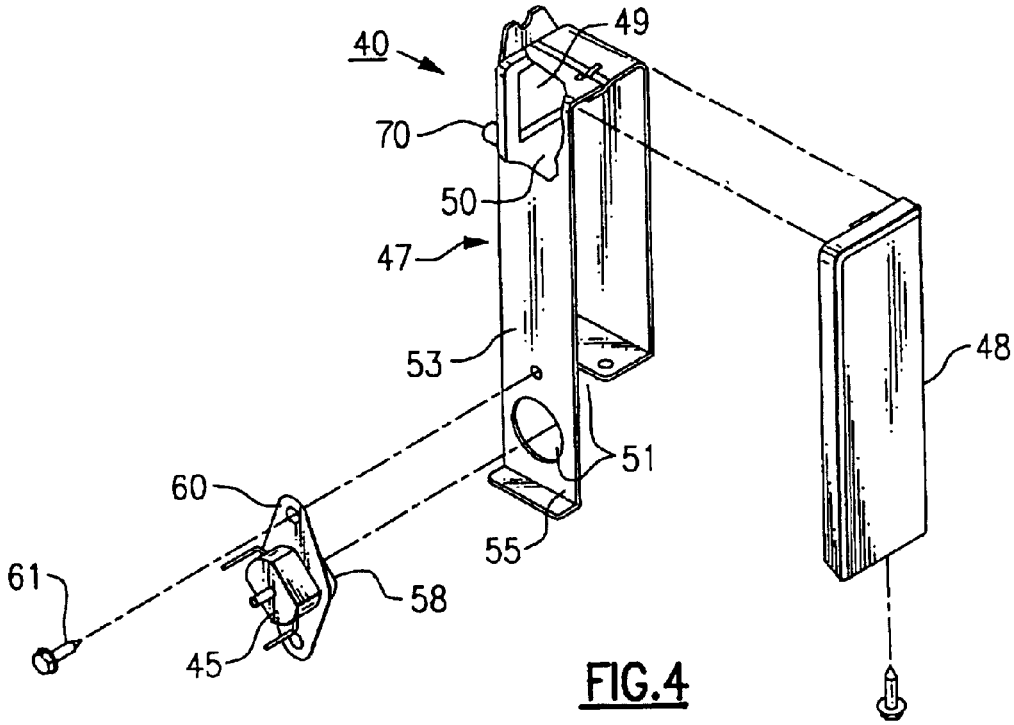
FIG. 4 shows an exploded view in perspective of the sensor housing.

Referring also to FIGS. 3–4, the sensor housing includes a three-sided body 47 that is closed by means of an access cover 48. A rectangular opening 49 is provided in a side wall 50 of the housing and one end 51 of the housing remains open so that air and gas can flow through the housing between openings 50 and 51. One side wall 53 of the housing extends outwardly beyond the other side walls and the extended section 55 thereof is furnished with a circular hole 57. Thermal switch 45 is equipped with a probe 58 which, in assembly, passes through the circular hole and is thus exposed to fluids moving into and out of the housing through the adjacent opening 51. Thermal switch 45 is secured to the extended section of side wall 53 by a bracket 60 and screws 61.

Vent elbow 24 includes a linear inlet section 63 that is connected to flange 30 mounted upon the front face of the inducer box. The inlet section, in turn, is connected to a linear outlet section 64 by means of a 90 degree bend section 65. A mounting pad 67 is provided upon the elbow inlet section which surrounds a rectangular opening 68 that passes through the elbow. The sensor housing is attached to the mounting pad using a screw 69 and a tab 70 that is insertable in a slot provided in the pad so that the opening 49 in the housing is in axial alignment with opening 68 in the pad. Once attached to the elbow, the interior of the housing is in fluid flow communication with the interior of elbow 24 so that fluids such as air and flue gases can be exchanged between elbow 24 and the surrounding ambient.

Due to the flue gas temperature and velocity within the inducer box, linear inlet section 63 of vent elbow 24 is placed under a negative pressure when furnace 10 is operating normally and the vent system is not restricted. In the event the vent system becomes blocked, the pressure within the elbow region increases. Accordingly, during normal operations ambient air is drawn through the sensor housing and passed into the vent system. When the vent becomes restricted, however, the pressure in the elbow increases. The direction of flow through the housing is thus reversed, causing hot flue gases to pass over the thermal switch probe. When the normally closed thermal switch 45 reaches its preset threshold temperature, switch 45 cycles open. Switch 45 remains open until such time as the probe temperature is reduced below the threshold level whereupon switch 45 resets automatically to the normally closed position.

Figure 5:
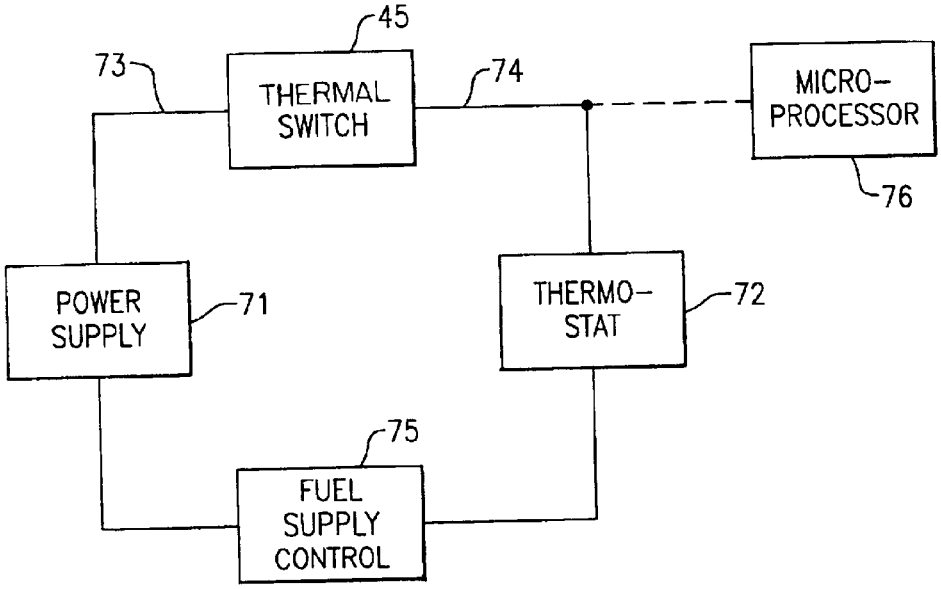
FIG. 5 shows a block diagram showing an arrangement of circuit elements, including the thermal switch of the safeguard system, for controlling the operation of a fuel supply system for the furnace shown in FIG. 1.

As illustrated in FIG. 5, the thermal switch 45 is connected in series between a furnace power supply 71 and a furnace thermostat 72 by leads 73 and 74. Thermal switch 45 and thermostat 72 control the flow of current to a fuel supply control 75, which includes a solenoid operated fuel control valve which regulates the flow of gas to burners 14 of furnace 10. When current flows to the control valve, thermostat 72 must be calling for heat and thermal switch 45 must be closed. Thermal switch 45 is located so that it trips when an over-pressure condition at the entrance to the vent system is detected, as evidenced by hot flue gasses passing over the thermal switch probe. However, thermal switch 45 can be tripped erroneously in the event of a down draft or at times when the vent pipe is exposed to high wind loads. As explained below, thermal switch 45 automatically resets to reinitiate the combustion cycle upon the occurrence of a nuisance trip.

Initially, when thermostat 72 calls for heat, a microprocessor 76 initiates a combustion cycle and monitors the condition of thermal switch 45. In the event thermal switch 45 opens, furnace 10 is programmed to shut down automatically and thermal switch 45 is allowed to automatically reset within a first preprogrammed period of time whereupon the combustion cycle is reinitiated. The preprogrammed period of time for switch 45 to reset is preferably between about one and four minutes. If the switch fails to reset within the first preprogrammed period of time, a cycle counter is incremented. The program further allows thermal switch 45 preferably to cycle three times with reset duration greater than the first preprogrammed period of time for so long as thermostat 72 continues to call for heat. If thermostat 72 is not satisfied after three such cycles, furnace 10 is shut down by microprocessor 76 for a second longer preprogrammed period, preferably about three hours. If thermostat 72 is still calling for heat at the end of the second time period, a new combustion cycle is initiated.

In the event the thermal switch cycles three times for a second time, and thermostat 72 is not satisfied, furnace 10 is again shut down for another preferable three hour period and the combustion cycle is again reinstituted.

Figure 6A:
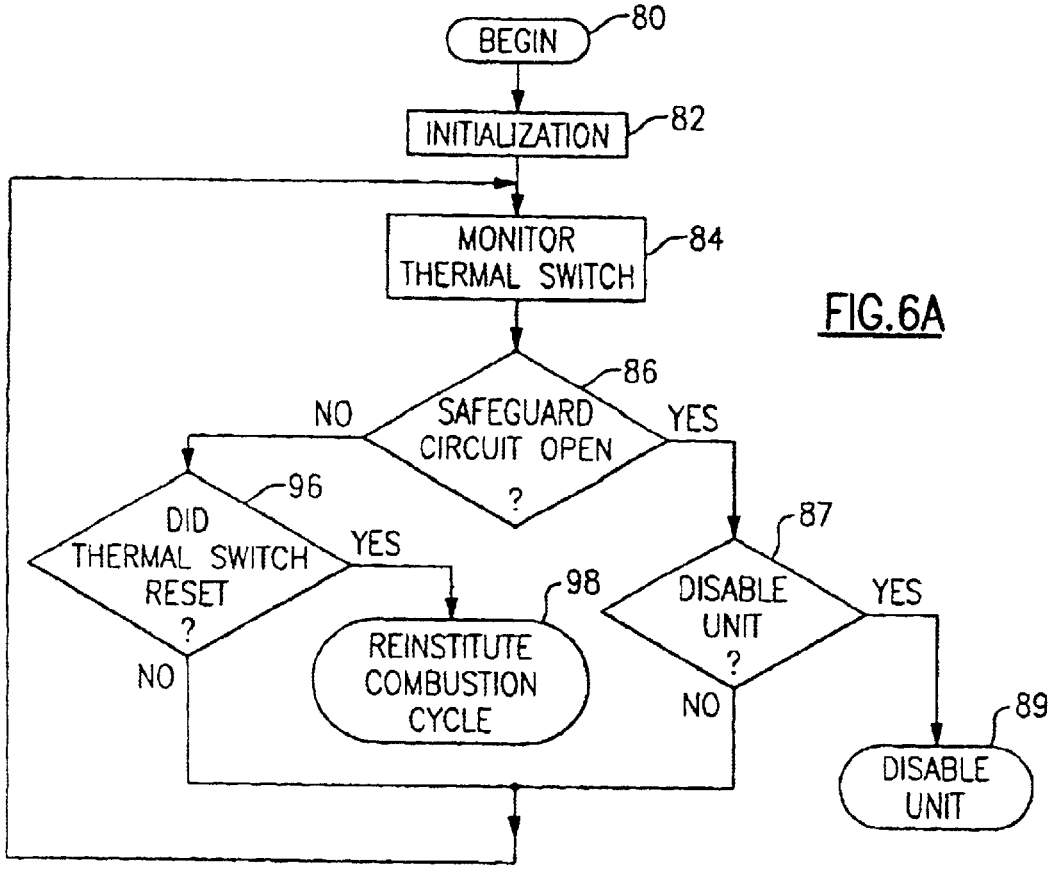
FIG. 6A shows part of a flowchart used in explaining an algorithm used in an embodiment of the present invention.
Figure 6B:
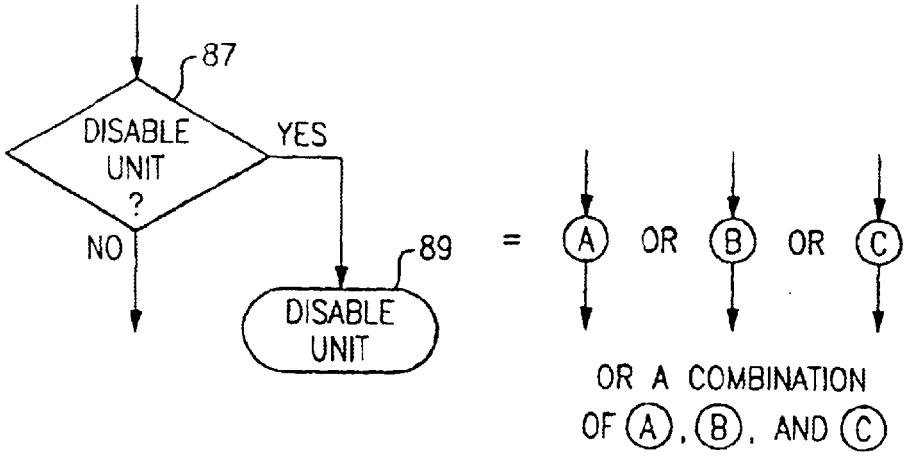
FIG. 6B shows part of a flowchart used in explaining an algorithm used in an embodiment of the present invention.
Figure 6C:
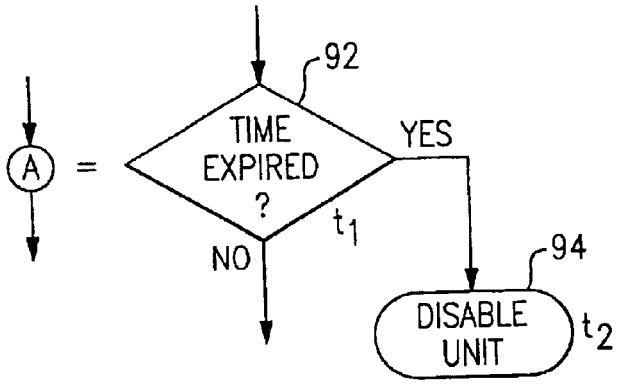
FIG. 6C shows part of a flowchart used in explaining an algorithm used in an embodiment of the present invention.
Figure 6D:
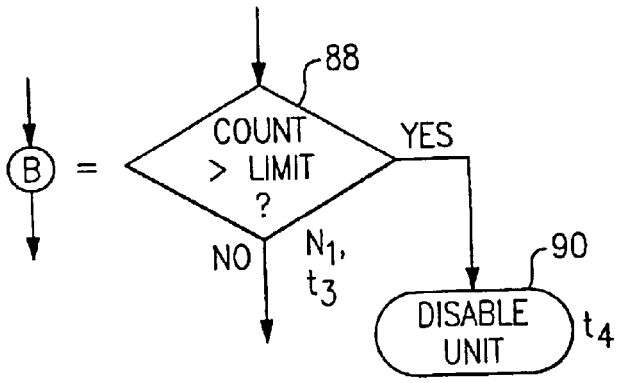
FIG. 6D shows part of a flowchart used in explaining an algorithm used in an embodiment of the present invention.
Figure 6E:
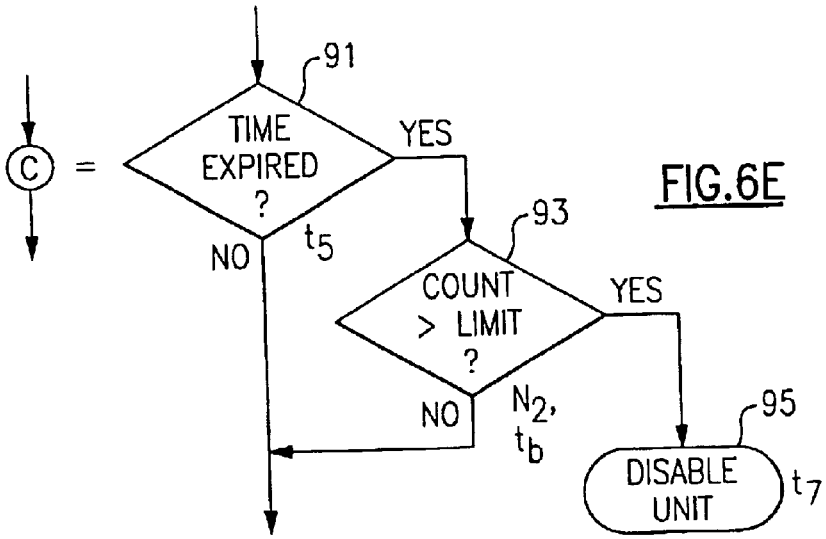
FIG. 6E shows part of a flowchart used in explaining an algorithm used in an embodiment of the present invention.

Referring to FIGS. 6A–6E, a flowchart of the control algorithm is shown. The "DISABLE UNIT?" conditional block of step 87 and its associated branch step 89 may be implemented in a variety of ways, as indicated in FIG. 6B. The goal of any implementation is to provide a self-recovery method without a significant increase in the pollutant accumulation within the conditioned space. Three possible implementations are shown in FIGS. 6C (Block A), 6D (Block B), and 6E (Block C). As shown in FIG. 6B, these blocks may be used singly or in combination, for example, Block A followed by Block B.

Block A implementation. The process begins in step 80 and initialization occurs in step 82. Thermal switch 45 is monitored in step 84, and if the safeguard circuit is open in step 86, the system checks in step 92 to see if a period of time t1 has expired, and if so, the unit is disabled in step 94 for a period of time t2. If time t1 has not expired, control reverts to step 84. If the safeguard circuit is closed in step 86, the system checks in step 96 to see if the thermal switch reset. If so, the combustion cycle is reinstituted in step 98; otherwise, control reverts to step 84.

Block B implementation. The process begins in step 80 and initialization occurs in step 82. Thermal switch 45 is monitored in step 84, and if the safeguard circuit is open in step 86, the number of switch openings (the count) that occurred within a time t3 is checked in step 88 to see if the number of switch openings exceeds the cycle limit, N1. If so, the unit is disabled in step 90 for a period of time t4. If the count does not exceed the cycle limit, control reverts to step 84. If the safeguard circuit is closed in step 86, the system checks in step 96 to see if the thermal switch reset. If so, the combustion cycle is reinstituted in step 98; otherwise, control reverts to step 84. In this implementation the cycle count is incremented when the thermal switch opens.

Block C implementation. The process begins in step 80 and initialization occurs in step 82. Thermal switch 45 is monitored in step 84, and if the safeguard circuit is open in step 86, the system checks in step 91 to see if a period of time t5 has expired, and if so, the number of switch openings (the count) within a time t6 is checked in step 93 to see if the number of switch openings exceeds the cycle limit, N2. If so, the unit is disabled in step 95 for a period of time t7. If the count does not exceed the cycle limit, control reverts to step 84. If time t5 has not expired, control reverts to step 84. If the safeguard circuit is closed in step 86, the system checks in step 96 to see if the thermal switch reset. If so, the combustion cycle is reinstituted in step 98; otherwise, control reverts to step 84. In this implementation the count is incremented when the period of time t5 expires following a switch opening. If the switch closes before time t5 expires, the count is not incremented.

This control algorithm allows a lock-out after the first trip. Preferably, for one particular furnace embodying the Block A implementation, after the draft safeguard switch has failed to reset within three minutes (t1), the furnace will lock out for three hours (t2). The draft safeguard thermal switch is selected so that it will necessarily take longer than three minutes to reset after it has opened. In another embodiment implementing Block A followed by Block B, the control algorithm allows ten (N1) switch openings within the current heating cycle (t3) should the switch close within the three minute period (t1), and upon the eleventh switch opening, disables the furnace for three hours (t4) and then reinstitutes the combustion cycle upon the resetting of the thermal switch. If upon any opening, the switch should take longer than three minutes (t1) to close, then the algorithm disables the furnace for three hours (t2) and then reinstitutes the combustion cycle upon the resetting of the thermal switch. In a Block C implementation, the algorithm counts the number of times during the current heating cycle (t6) that the switch has opened and remained open for more than three minutes (t5). If the count exceeds 2 (N2), then the algorithm disables the furnace for three hours (t7) and then reinstitutes the combustion cycle upon the resetting of the thermal switch.

The following Tables 1A and 1B provides the preferable values for the Carrier furnace product according to an embodiment of the invention:

TABLE 1A

| Implementation | t1 | t2 | N1 | t3 | t4 |
|---|---|---|---|---|---|
| Block A | 3 min | 3 hr | N/A | N/A | N/A |
| Block A + B | 3 min | 3 hr | 10 | one heating cycle | 3 hr |

TABLE 1B

| Implementation | t5 | N2 | t6 | t7 |
|---|---|---|---|---|
| Block C | 3 min | 2 | one heating cycle | 3 hr |

Possible ranges (low to high) and approximate values for these parameters are contained in Tables 2–5.

TABLE 2

| | t1, t5 | Comment |
|---|---|---|
| low | 1 min | Lower limit on common switch closing times |
| high | 10 min | Upper limit on common switch closing times |
| approx. | 3 min | Preferable for Carrier product |

Rationale: The expected switch closing time may be used to validate a switch closing. A switch reset time less than t1 or t5 may indicate an erroneous trip. The 1 min. and 10 min. values are estimates. Routine experimentation on available switches and their performance in furnace flue applications would be needed to substantiate these choices.

TABLE 3

| | t2, t4, t7 | Comment |
|---|---|---|
| low | 1 hr | Common period in pollutant exposure guidelines |
| high | 8 hr | Common period in pollutant exposure guidelines |
| approx. | 3 hr | Preferable for Carrier product |

Rationale: The low or high value could be based on a published limit for exposure to a particular pollutant (e.g., CO) during a specified period. Computer simulations could be used to determine whether pollutant build-up exceeds an acceptable limit in the given period.

TABLE 4

| | N1, N2 | Comment |
|---|---|---|
| low | 0 | Immediately disable unit |
| high | 20 | Assumes 3 min. cycles, try for 1 hr. to restart |
| approx. | N1 = 10<br>N2 = 2 | Preferable for Carrier product |

Rationale: The low value assumes that even one combustion cycle and subsequent switch opening may be sufficient to warrant disabling the unit. The high value assumes the following cycle: 1 min. to initiate combustion, 1 min. for switch to open while burners operate, 1 min. for switch to close after opening. In this case the furnace runs for 20 min. during the course of an hour. The ensuing pollutant build-up may exceed an acceptable limit.

TABLE 5

| | t3, t6 | Comment |
|---|---|---|
| low | 1 hr. | Transitory condition |
| high | 24 hrs. | More persistent conditions |
| approx. | 1 heating cycle | Preferable for Carrier product |

Rationale: The low value is consistent with a transitory condition such as high wind conditions or momentary downdrafts. The high value is consistent with more persistent conditions, possibly weather related, which may dissipate in the course of a day. The preferred embodiment for the Carrier product assumes one heating cycle, which lasts as long as there is a call for heat, possibly several days.

As noted above, the particular choice of the parameters t1, t2, N1, t3, t4, t5, N2, t6, and t7 preferably are based on a strategy that balances the objective of not exceeding allowable pollutant levels with the objective of avoiding the adverse consequences of erroneous furnace shutdown.

Computer analyses and tests have been conducted on a furnace employing the above methodology which show that the restart procedure at three hour intervals results in a very low pollutant level within an average home having a tight construction and hence a relatively low air infiltration rate. The pollutant levels in this type of structure were found to be within acceptable limits after the above noted restart procedure was repeated over a relatively long period of time. The benefit of the above noted methodology lies in the fact that some heat can be provided to an unoccupied structure which will delay and, under certain conditions, prevent water in pipes and fixtures from becoming frozen during cold weather, thus causing potentially heavy and expensive damage. It should also be evident that the present methodology will allow the furnace to quickly recover in the event the thermal switch is tripped erroneously due to high winds or sudden downdrafts, particularly in older homes having marginal venting systems which are not always compatible with newer furnaces.

Figure 7:
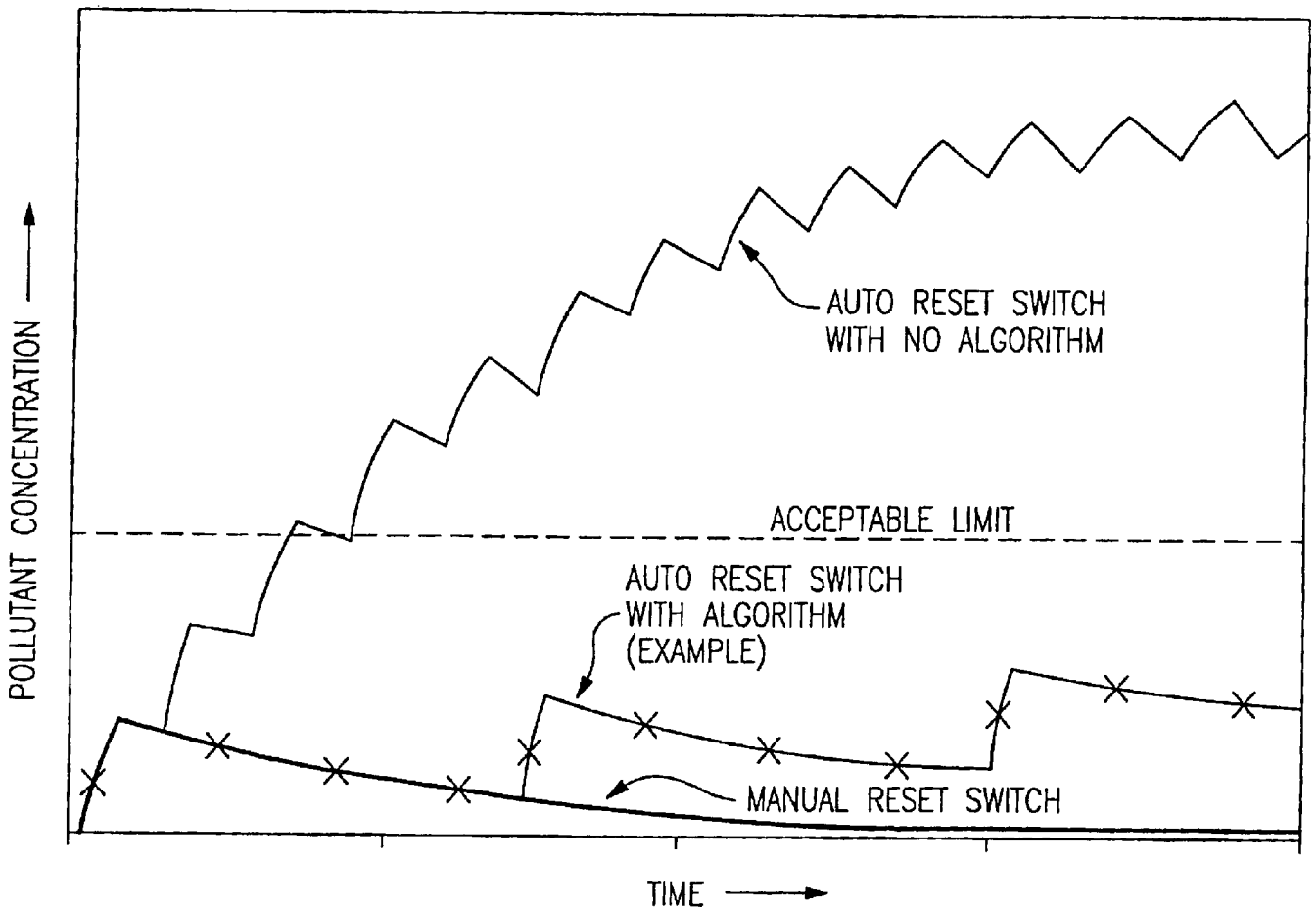
FIG. 7 shows a graph of predicted pollutant concentration versus time for three configurations of a draft safeguard thermal switch system.

FIG. 7 illustrates the advantages of the above methodology. The figure shows a graph of predicted pollutant concentration versus time for three configurations of a draft safeguard thermal switch system: (1) manual reset switch, (2) autoreset switch with no algorithm, and (3) autoreset switch with a sample algorithm. In all three cases, the thermostat is continually calling for heat. A manual switch trips once and disables the furnace until the switch is manually reset. Although the pollutant concentration remains low, the structure receives no heat. For the case of an autoreset switch with no algorithm, the structure continues to receive heat during periods when the switch is closed, but the pollutant concentration may rise above an acceptable limit. An autoreset switch with algorithm provides some heat to the structure while keeping the pollutant concentration below an acceptable limit.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. In a gas furnace that is responsive to a thermostat, and which contains a power supply, a gas valve, and an autoresettable thermal switch having a thermal switch probe that is responsive to an over-pressure condition, and a microprocessor responsive to said thermostat and said thermal switch for controlling said power supply and said gas valve, and wherein said gas furnace includes a furnace vent system, a process for detecting a blockage in said furnace vent system, comprising the steps of:

mounting said autoresettable thermal switch adjacent to an entrance to said furnace vent system so that said thermal switch opens due to a flue pressure exceeding a certain level and causing hot flue gasses to pass over said thermal switch probe;

electrically connecting said thermal switch in series between said power supply and said thermostat;

programming said microprocessor to carry out the following steps upon said thermostat calling for heat;

(a) instituting a combustion cycle;

(b) sensing a condition of said thermal switch and detecting when said thermal switch opens;

(c) determining, when said thermal switch is open, whether the number of openings of said thermal switch or the duration that said thermal switch remains open exceeds a preprogrammed criterion;

(d) disabling, when the number of openings of said thermal switch or the duration that said thermal switch remains open exceeds said preprogrammed criterion, said furnace and reinstituting said combustion cycle after said furnace has been disabled for a specified period of time; and (e) allowing, when said thermal switch is open and said furnace is not in a disabled state, said thermal switch to reset and reinstituting said combustion cycle upon resetting said thermal switch.

2. A method according to claim 1, wherein step (c) determines whether said thermal switch remains open for a period that exceeds a first preprogrammed period of time, and wherein step (d) reinstitutes said combustion cycle after said furnace has been disabled for a second preprogrammed period of time.

3. A method according to claim 2, wherein said first preprogrammed period of time is zero seconds.

4. A method according to claim 2, wherein said first preprogrammed period of time is between about 1 and about 10 minutes.

5. A method according to claim 4, wherein said first preprogrammed period of time is about 3 minutes.

6. A method according to claim 2, wherein said second preprogrammed period of time is between about 1 hour and about 8 hours.

7. A method according to claim 6, wherein said second preprogrammed period of time is about 3 hours.

8. A method according to claim 1, wherein step (c) determines whether said limit thermal switch is opened more than a first preprogrammed number of times during a third preprogrammed period of time, and wherein step (d) reinstitutes said combustion cycle after said furnace has been disabled for a fourth preprogrammed period of time.

9. A method according to claim 8, wherein said first preprogrammed number of times is zero.

10. A method according to claim 8, wherein said first preprogrammed number of times ranges from 1 to 20.

11. A method according to claim 10, wherein said first preprogrammed number of times is 10.

12. A method according to claim 8, wherein said third preprogrammed period of time is between about 1 hour and about 24 hours.

13. A method according to claim 12, wherein said third preprogrammed period of time is one heating cycle.

14. A method according to claim 8, wherein said fourth preprogrammed period of time is between about 1 hour and about 8 hours.

15. A method according to claim 14, wherein said fourth preprogrammed period of time is about 3 hours.

16. A method according to claim 1, wherein step (c) determines whether said thermal switch remains open for a period that exceeds a fifth preprogrammed period of time and determines whether the number of times that said thermal switch is opened and remains open for a period greater than a fifth preprogrammed period of time exceeds a second preprogrammed number of times during a sixth preprogrammed period of time, and wherein step (d) reinstitutes said combustion cycle after said furnace has been disabled for a seventh preprogrammed period of time.

17. A method according to claim 16, wherein said fifth preprogrammed period of time is between about 1 and about 10 minutes.

18. A method according to claim 17, wherein said fifth preprogrammed period of time is about 3 minutes.

19. A method according to claim 16, wherein said second preprogrammed number of times ranges from 1 to 20.

20. A method according to claim 19, wherein said second preprogrammed number of times is 2.

21. A method according to claim 16, wherein said sixth preprogrammed period of time is between about 1 hour and about 24 hours.

22. A method according to claim 21, wherein said sixth preprogrammed period of time is one heating cycle.

23. A method according to claim 16, wherein said seventh preprogrammed period of time is between about 1 hour and about 8 hours.

24. A method according to claim 23, wherein said seventh preprogrammed period of time is about 3 hours.

25. A method according to claim 1, wherein said step of disabling the furnace includes the step of closing said gas valve.

* * * * *